United States Patent [19]

Storlie et al.

[11] 4,095,445

[45] Jun. 20, 1978

[54] OFF-CENTER LOCKING HANDLE

[75] Inventors: Llewellyn O. Storlie, Spring Grove, Minn.; James F. Beatty, Decorah, Iowa

[73] Assignee: Deco Products Company, Decorah, Iowa

[21] Appl. No.: 761,866

[22] Filed: Jan. 24, 1977

[51] Int. Cl.[2] ..... E05B 13/10

[52] U.S. Cl. ..... 70/215

[58] Field of Search ..... 70/215-217, 70/210, 176, 224, 192, 201, 370, 371, 416

[56] References Cited

U.S. PATENT DOCUMENTS

| | | | |
|---|---|---|---|
| 1,447,651 | 3/1923 | Farmer | 70/215 X |
| 1,892,447 | 12/1932 | Carr et al. | 70/371 |
| 2,255,418 | 9/1941 | Fletcher | 70/215 |
| 2,939,308 | 6/1960 | Trammell, Jr. | 70/215 X |
| 3,199,321 | 8/1965 | Sollenberger | 70/370 X |
| 3,402,581 | 9/1968 | Schweizer et al. | 70/416 X |

FOREIGN PATENT DOCUMENTS

| | | | |
|---|---|---|---|
| 6,807,229 | 11/1969 | Netherlands | 70/216 |
| 110,205 | 3/1944 | Sweden | 70/216 |

*Primary Examiner*—Roy D. Frazier
*Assistant Examiner*—William E. Lyddane
*Attorney, Agent, or Firm*—Merchant, Gould, Smith, Edell, Welter & Schmidt

[57] ABSTRACT

A locking handle for doors, particularly doors of vehicles and industrial equipment, is disclosed. The locking handle is secured to a shaft which activates a door latch upon rotation of the handle. A lock member is held within the locking handle and has a projection which selectively engages an annular projection of an escutcheon secured to the door. In the preferred embodiment the locking handle has an aperture and the lock member is a cylinder having one portion with a diameter greater than the diameter of the aperture and a second portion with a diameter smaller than the diameter of the aperture, the second portion projecting through the aperture. The lock member thus cannot be removed from the handle exterior.

5 Claims, 4 Drawing Figures

OFF-CENTER LOCKING HANDLE

BACKGROUND OF THE INVENTION

The present invention relates broadly to a locking handle for doors and, in particular, to a locking handle for the doors of vehicles and industrial equipment.

The prior art locking handles typically include lock cylinder mechanisms which are mounted concentric with the axis of rotation of the door handle. These lock cylinder mechanisms rotate to move a member outward into contact with a portion of an escutcheon thereby preventing rotation of the handle. In this type of locking handle, the lock cylinder mechanism generally must be inserted in the locking handle from the exterior of the handle and is therefore subject to removal and picking of the lock. Additionally, the linkage mechanism provided between the lock cylinder and the escutcheon is susceptible to freezing and mechanical breakage problems.

In the prior art lock cylinders also have been mounted off-center with respect to the axis of rotation of the locking handle. These prior art devices are also structured so that the lock cylinder is installed from the exterior of the handle subjecting the lock cylinder to tampering and removal. Additionally, the linkage mechanisms discussed above are included in the off-center prior art locking handles and are subject to the same freezing and breakage problems.

The present invention eliminates the disadvantages of the prior art locking handles in that it is a locking handle having a lock member mounted off-center with respect to the axis of rotation of the locking handle and which is installed from the rear of the locking handle and retained within the handle such that the lock member cannot be removed from the exterior of the handle. Additionally, the lock cylinder itself is provided with a projection that selectively engages an escutcheon to prevent rotation of the locking handle. The present invention, thus, does not require a linkage mechanism between the lock member and the escutcheon and therefore problems associated with linkage mechanisms are eliminated.

SUMMARY OF THE INVENTION

The present invention is a locking handle for a door in which the handle is rotatable between door latched and unlatched positions and in which the handle is secured to a shaft that actuates the door latch. The handle has a first portion that includes a lock member chamber and an escutcheon is secured to the door. A lock member is rotatably received within the lock member chamber and has a projection that selectively engages an annular projection on the escutcheon. The lock member is rotatable between a locked position in which the lock member projection engages the annular projection and an unlocked position in which the lock member projection is disengaged from the annular projection. Further, the locking handle includes a structure for retaining the lock member within the lock member chamber such that the lock member cannot be removed from the locking handle by exterior tampering.

In the preferred embodiment, the latch actuating shaft is aligned along the central axis of the first portion of the locking handle. The lock member is disposed along an axis parallel to the shaft axis and the first portion of the locking handle substantially encloses the escutcheon. The first portion has an aperture through which a portion of the lock member extends. The lock member has a first portion with a diameter greater than the diameter of the aperture and a second portion with a smaller diameter than the aperture, such that the second portion projects through the aperture. The large diameter first portion of the lock cylinder, therefore, prevents the removal of the lock member through the aperture in the locking handle.

The present invention thus provides a simple, positive acting locking mechanism that is substantially tamperproof and which minimizes the problems of freezing and mechanical malfunction. These and other advantages of the invention will become apparent with reference to the drawings, detailed description of the preferred embodiment, and claims.

DETAILED DESCRIPTION OF THE PREFERRED EMBODIMENT

Figure 1:
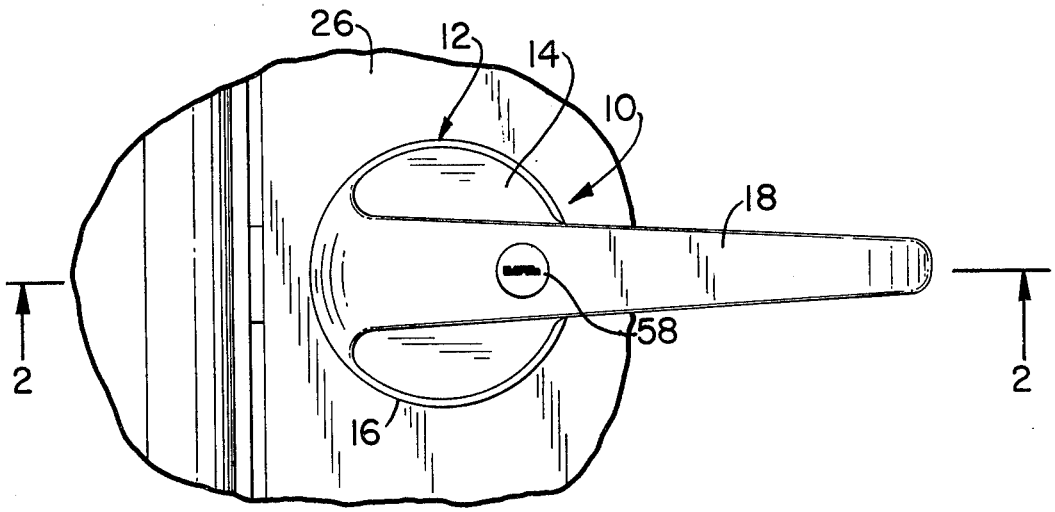
FIG. 1 is a view in elevation of the locking handle incorporating the present invention.

Referring to the drawing, wherein like numerals represent like parts throughout the several views, the locking handle of the present invention is illustrated generally as 10. Locking handle 10 includes a basically cup-shaped member 12 having a base 14 and a side wall 16. Integral with and extending from member 12 is a grasping portion 18. Base 14 and side wall 16 define a chamber 20. Extending into chamber 20 from base 14 along a substantially central axis of member 12 is a cylindrical portion 22 having an aperture which receives a shaft 24. Shaft 24 is connected to a door latching device (not shown) such that when shaft 24 is rotated by handle 10 the latch mechanism is operated. Secured to a door 26 by a plurality of fasteners 28 is an escutcheon 30 having a base 32 and an annular projection 34. Escutcheon base 32 is essentially cylindrical having an aperture 33 through which shaft 24 extends. In the preferred embodiment, projection 34 is provided with cut-outs as indicated at 36 and 38. Cut-outs 36 and 38 define surfaces 40 on annular projection 34 which are engaged by a lock member as will be described in more detail hereafter to prevent rotation of locking handle 10.

Also extending into chamber 20 along an axis parallel to the axis of shaft 24 is a tubular member 42 which defines a second chamber 44 for receiving a lock member 46 that in the preferred embodiment is a cylinder. An aperture 48 is formed in base 14 of cup-shaped member 12 and provides an opening between chamber 44 and the exterior of locking handle 10. Lock member 46 has a body portion 50 which is cylindrical and has a diameter greater than the diameter of aperture 48. Lock member 46 also includes a cylindrical top portion 52 having a diameter slightly smaller than the diameter of aperture 48 such that portion 52 extends through aperture 48 and has a top surface which is flush with the surface of base 14. The respective diameters of body portion 50 and aperture 48 therefore prevent the removal of lock member 46 through aperture 48 significantly decreasing the possibility of lock tampering.

Lock member 46 has a projection 54 which is basically a half-cylinder extending from body portion 50. Projection 54 has a surface 56 which is adapted to engage surfaces 40 to prevent rotation of locking handle 12. Lock member 46 is provided with a key guide 58 into which a key (not shown) is inserted to rotate locking member 46 within chamber 44.

Figure 2:
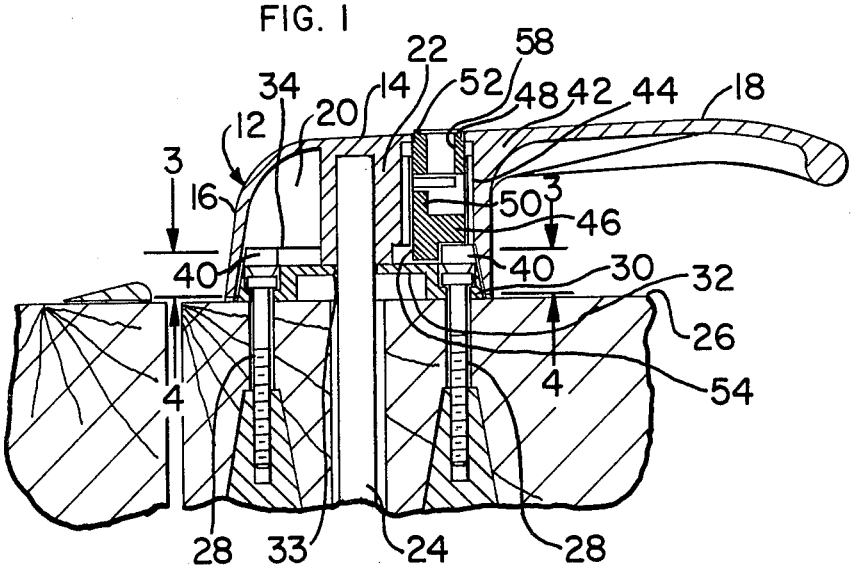
FIG. 2 is a sectional view as seen generally along the line 2—2 of FIG. 1.
Figure 3:
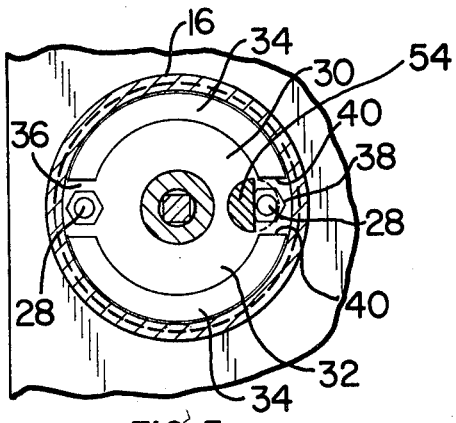
FIG. 3 is a fragmentary sectional view taken generally along the line 3—3 of FIG. 2.
Figure 4:
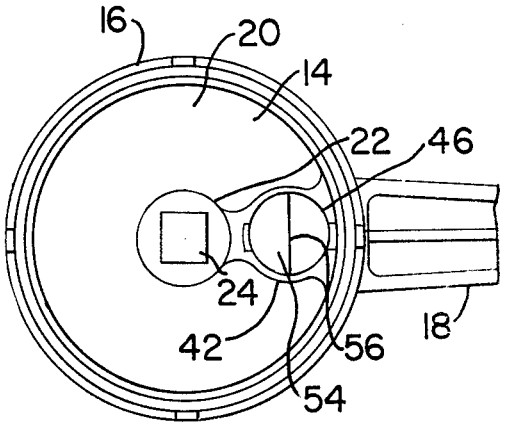
FIG. 4 is a fragmentary view in elevation of the interior of the locking handle as seen generally from line 4—4 of FIG. 2.

The operation of the present invention will now be described with particular reference to FIG. 2 and FIG. 3. With lock member 46 disposed in the position illustrated in FIGS. 2 and 3, locking handle 10 may be rotated, thereby rotating shaft 24 and actuating the door latch (not shown). It can be seen, particularly with reference to FIG. 3, that projection 54 will not engage annular projection 34 of escutcheon 30 as locking handle 10 is rotated. Surface 56 will clear projection 34 as locking handle 10 is rotated. To prevent rotation of locking handle 10 and thereby lock the door, lock member 46 is simply rotated within chamber 44 to a position in which surface 56 will engage surfaces 40 of annular projection 34 interfering with the rotation of locking handle 10. Lock member 46 is typically rotated within chamber 44 by the insertion of a key (not shown) into key guide 58. By providing a pair of cut-outs at 36 and 38 locking handle 10 may be locked in two positions against rotation. Additional cut-outs could be provided for a plurality of variable locked positions. As previously mentioned, the diameters of body portion 50 and aperture 48 effectively prevent the removal of lock member 46 from locking handle 10. Additionally, escutcheon 30 is essentially enclosed by cup-shaped member 12 so that escutcheon 30 cannot be removed in an attempt to tamper with or pick the door lock.

The present invention, thus, is an improved door locking handle that is essentially tamper-proof. The tamper-proof nature of the present invention stems in large part from the structure of the lock member which cannot be removed from the exterior of the locking handle. Additionally, the lock member itself has a projection which engages an escutcheon to prevent rotation of the locking handle as opposed to numerous prior art structures in which a lock member actuates an intermediate member which then engages an escutcheon member. Thus, the present invention is less subject to mechanical malfunction than the prior art devices.

We claim:

1. A locking handle for a door, said handle secured to a shaft disposed along the central axis of the handle and connected to a door latch, the handle rotatable about the central axis between door latched and door unlatched positions, comprising:

(a) a housing member having a lock cylinder chamber;

(b) a lock cylinder received within said lock cylinder chamber and disposed along an axis spaced apart from and parallel to the central axis at a first radial position from said central axis, said lock cylinder having an integral first projection and rotatable between a first locked position and a second unlocked position;

(c) an estucheon secured to the door and enclosed within said housing member, said estucheon having a second projection disposed at a second radial position from the central axis of the handle spaced apart from the first radial position of said lock cylinder axis, said second projection having an engagement surface disposed in a plane normal to the door and parallel to a plane containing the central and lock cylinder axes, said lock cylinder rotatable about its central axis so that said first projection directly engages said engagement surface in said first locked position and is disengaged from said engagement surface in said second unlocked position;

(d) means for retaining said lock cylinder within said housing member so that said lock cylinder cannot be externally removed from said lock cylinder chamber.

2. A locking handle in accordance with claim 1 wherein said housing portion has an aperture therein opening into said lock cylinder chamber, and wherein said lock cylinder has a first portion with a diameter larger than the diameter of said aperture, and a second portion with a diameter smaller than the diameter of said aperture whereby said lock cylinder cannot be removed through said aperture.

3. A locking handle in accordance with claim 1 wherein said estucheon includes a plurality of projections circumferentially disposed at said second radial position about the central axis, each projection having an engagement surface disposed in a plane normal to the door and parallel to a plane containing the parallel central and lock cylinder axes whereby said locking handle may be locked against rotation in a plurality of positions.

4. A locking handle in accordance with claim 1 wherein said estucheon further comprises:

(a) a substantially cylindrical base member;

(b) an annular projection formed integrally with said base proximate the outer edge thereof at said second radial position, said annular projection provided with a cut-out segment defining said engagement surface disposed for selective engagement by said first projection of said lock cylinder.

5. A locking handle in accordance with claim 1 wherein said annular projection is provided with a plurality of cut-out segments defining a plurality of engagement surfaces circumferentially disposed about the central axis whereby said locking handle may be locked against rotation in a plurality positions.

* * * * *